United States Patent [19]

Estey

[11] Patent Number: 4,550,738

[45] Date of Patent: Nov. 5, 1985

[54] SANITARY ASHTRAY SYSTEM

[76] Inventor: Herman C. Estey, P.O. Box 3024, Longwood, Fla. 32750

[21] Appl. No.: 593,657

[22] Filed: Mar. 26, 1984

[51] Int. Cl.[4] ..... A24F 19/14

[52] U.S. Cl. ..... 131/236; 131/231; 131/241; 210/167; 210/259

[58] Field of Search ..... 131/231, 235 R, 236, 131/241, 242, 240 R; 4/420, 431, 262, 263, 213, 216; 210/167, 259

[56] References Cited

U.S. PATENT DOCUMENTS 2,754,145 7/1956 Mackey ..... 131/236

3,922,730 12/1975 Kemper ..... 210/167

4,423,743 1/1984 Spielvogel ..... 131/231

*Primary Examiner*—V. Millin

*Assistant Examiner*—H. Macey

[57] ABSTRACT

An ashtray system for bars, restaurants, and the like having a plurality of ash receivers. Each receiver is supplied with swirling water from a central reservoir and a drain connected via a filter back to the reservoir. Ashes, debris, and smoke are carried by the water to the filter to reduce smoke pollution and to maintain a clean, sanitary condition of the ash receivers. The reservoir may include deodorizing and disinfecting chemicals in the water and the filter is replaceable.

5 Claims, 3 Drawing Figures

SANITARY ASHTRAY SYSTEM

BACKGROUND OF THE INVENTION

1. Field of the Invention

The present invention relates to an ashtray system, and more particularly to a system for bars, restaurants, and the like, which will minimize air pollution from tobacco smoke.

2. Description of the Prior Art

It is known to provide ashtrays for smokers in which ashes and cigarette butts are dropped into a reservoir. However, while disposing of debris from smokers, the smoke produced during use of the cigarettes enters the air of the room. With a general decrease in smoking, bars, restaurants, and the like have attempted to reduce the health hazards and annoyance to non-smokers of smoke in the air by setting aside non-smoking sections. Such approach is not very practical for bars and lunch counters. Thus, there is a need for an ashtray system that will minimize smoke in the air and will quickly dispose of discarded smoldering cigarette butts.

SUMMARY OF THE INVENTION

My invention is an ashtray system having a plurality of ash receivers each including an essentially circular bowl, a water jet disposed in the bowl, and a drain. The bowl may include a plurality of grooves for holding lighted cigarettes.

A pump provides a stream of water under pressure which issues from the water jet. The jet is disposed to cause the water to swirl around the bowl. The water drains from the bowl to a central filter from which it is pumped to a central reservoir. The swirling water creates a slight suction of air, or downdraft, which tends to draw smoke near the bowl down the drain. When ashes or cigarette butts are deposited in the bowl, such residues are washed down the drain.

In a typical application, a number of the ash receivers may be installed along a bar or counter and plumbed to connect all of the drains to the central filter and all of the water jets to a water pump. A central reservoir is provided for storing a supply of water which may be treated with deodorizing chemicals. The water pump draws water from the reservoir and the filtered drain water is pumped into the reservoir. A drain from the reservoir may be connected to the building sewer via a valve to permit periodic draining of the water to thereby permit refilling with fresh water.

It is therefore a principal object of my invention to provide a central ashtray system which will carry away ashes, cigarette butts, and smoke from the ashtrays.

It is another object of my invention to provide a central ashtray system which continuously flushes the ash receivers and carries away smoke and odors.

It is still another object of my invention to provide an ashtray system having a central reservoir for chemically-treated water, which is circulated through the ash receivers and is filtered to remove debris and impurities.

It is still another object of my invention to provide a central ashtray system which is effective in reducing smoke in the room and pollution of the air to increase the comfort of the occupants.

It is a further object of my invention to provide a centralized ashtray system having an ashtray receiver with air vents connected to a source of vacuum for drawing in smoke from smoking materials placed on the ash receiver and for smoke in the vicinity of the receivers.

These and other objects and advantages of my invention will become apparent from the following detailed description when read in conjunction with the drawings.

DETAILED DESCRIPTION OF THE PREFERRED EMBODIMENT

Figure 1:
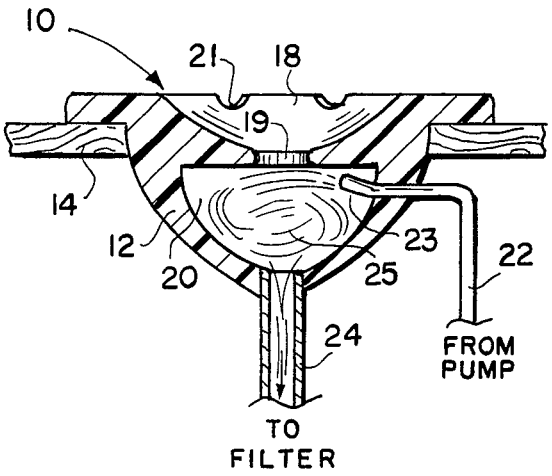
FIG. 1 is a cross-sectional view of an ash receiver in accordance with my invention.

My invention contemplates a central ashtray system having a plurality of ash receivers 10. FIG. 1 presents a cross-sectional view of a typical ash receiver 10 in accordance with my invention. The ash receiver, shown generally at 10, includes a bowl portion 12 mounted in a counter or table top 14. Bowl 12 includes an ashtray portion 18 for receiving ashes, cigarette butts, and the like and may include a series of grooves 21 to permit cigarettes to be rested therein. A large opening 19 is provided in the bottom of ashtray portion 18, communicating with a chamber 20. As will be understood, ashes and cigarette butts, and the like will pass through opening 19 into chamber 20. A water jet 23 is provided in chamber 20, fed from waterline 22. Jet 23 is formed to cause water under pressure emanating therefrom to swirl around bowl 20. A drain 24 is provided at the bottom of bowl 20 to permit draining of water 25.

The swirling of water 25 and its flow out through drain 24 will create a venturi effect through the center thereof, assisting in drawing ashes and the like through opening 19 to be swept away and flushed out through drain 24. Similarly, a gentle flow of air from the region above ash receiver 10 is created, which will draw smoke into chamber 20, which will be dissolved in water 25 and carried away, thus reducing the pollution of the air.

Figure 2:
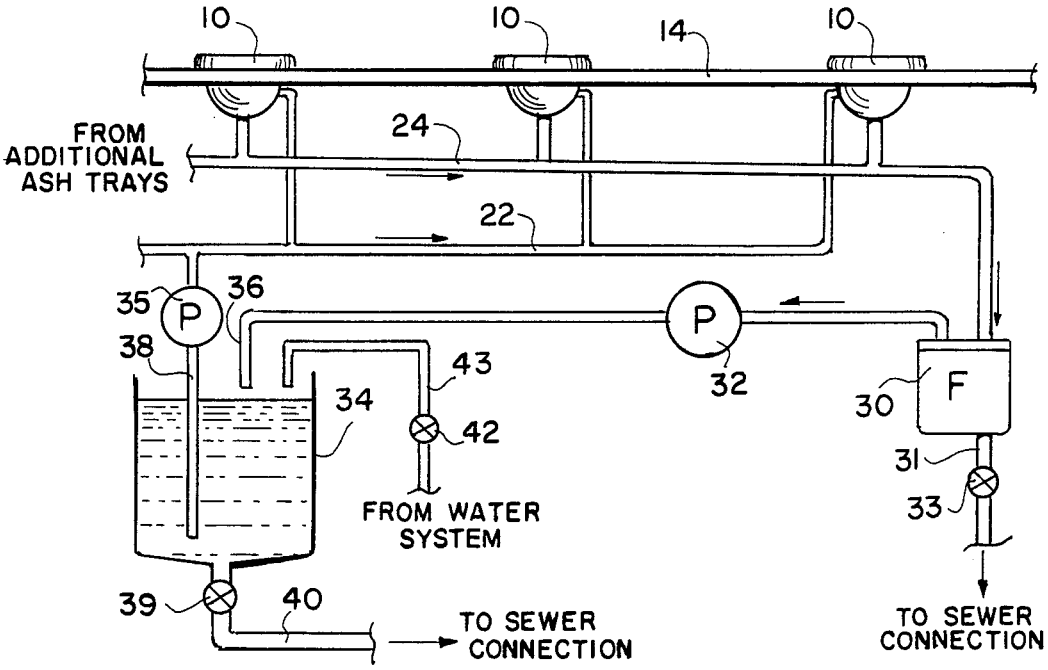
FIG. 2 is a schematic view of a part of a system having a multiplicity of ash receivers of FIG. 1 installed in a counter or the like and showing the flushing, filtering, and circulating system of my invention.

FIG. 2 illustrates a typical installation of my central ashtray system showing three ash receivers 10 installed in a counter 14. A reservoir 34 is provided which is filled with water in which disinfecting and deodorizing chemicals may be dissolved. Water from reservoir 34 is pumped by pump 35 via a standpipe 38 to waterline 22, thereby supplying the treated water under pressure into each of the ash receivers 10. Drains 24 are connected to central filter 30 with flow being produced by both gravity and the effect of pump 32. Filter 30 is preferably of the rechargeable type having a replaceable filter element. Sufficient space is provided in filter 30 to permit collection of ashes, cigarette butts, and similar debris. A drain 31 and drain valve 33 are provided to permit draining of the filter 30 and flushing when the filter element is changed. Pump 32 pumps the filtered and treated water from filter 30 back to reservoir 34 via an inlet 36.

Reservoir 34 includes a drain valve 39 conected to the local sewer by line 40. This arrangement permits periodic draining of reservoir 34 at a time when contamination passing through filter 30 becomes excessive.

Reservoir 34 may then be refilled with fresh water by waterline 43 and valve 42 from the local water sytem.

Although three ash receivers 10 have been illustrated in FIG. 2, it may be noted that water feedline 22 and drainline 24 may be connected to additional ash receivers as desired.

Where conservation of water is not a major consideration, it will be obvious to those of skill in the art that line 22 may be fed directly from the local water supply system and drainline 24 connected through conventional traps to the sewer connection.

Figure 3:
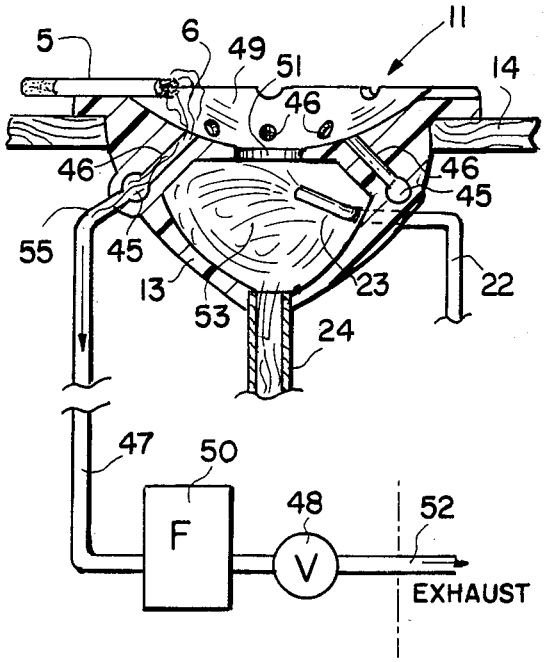
FIG. 3 shows a cross section of an alternative ash receiver having vacuum means for drawing in smoke from smoking materials.

An alternative ash receiver 11 is illustrated in cross-sectional view in FIG. 3. Ash receiver 11 includes a bowl 13 which may be, for example, circular, having an ashtray portion 49 communicating with a chamber portion 53. Bowl 13 includes an annular conduit 45 encircling bowl 13. A plurality of channels 46 spaced around bowl 13 communicate between annular conduit 45 and the interior of ashtray portion 49. A connection 55 connects annular conduit 45 to exhaust line 47 which is connected to the input of filter 50, which may be of the replaceable type, with the output of filter 50 connected to vacuum pump 48. As may now be recognized, vacuum on annular conduit 45 causes air to be pulled in through openings 46, which will be exhausted out exhaust line 52, preferably external to the building. This incoming air will carry smoke from smoking materials through filter 50 and will exhaust by exhaust 52. Thus, the cigarette shown at 5 will have its smoke 6 withdrawn thus preventing annoyance to persons seated near table 14.

As may now be understood, I have disclosed a novel central ashtray system having a plurality of ash receivers, which are maintained in a clean and sanitary condition automatically by a centralized source of treated water and means for filtering the water to remove debris therefrom. My invention will greatly reduce the pollution in bars, restaurants, and similar establishments where much smoking is prevalent, producing a more healthful atmosphere, especially for nonsmokers. Although I have disclosed certain specific embodiments of my invention, these are for exemplary purposes only and it will be obvious to those of skill in the art to make numerous modifications thereto without departing from the spirit and scope of my invention.

I claim:

1. An ashtray system comprising:

a reservoir for holding a supply of water;

a plurality of ash receivers, each of said receivers comprising an ashtray and a water chamber, each said ashtray having groove means for holding cigarettes eahc said chamber being separate from and disposed below each said ashtray; each said ashtray having an opening in the lower portion thereof communicating with the corresponding one of said chambers, each said chamber having a drain attached to a lower portion thereof and a water jet disposed along one wall thereof;

first pump means for drawing water from said reservoir;

a waterline connected from an output of said pump to said water jet of each of said ash receivers for supplying water under pressure to said jet;

a filter;

a drainline connected between said drain of each of said ash receivers and said filter; and second pump means connected to said filter and to said reservoir for pumping filtered water from said filter into said reservoir.

2. The system as defined in claim 1 in which said reservoir includes a drain valve and drain for removing said water from said reservoir; and a water inlet to said reservoir for refilling after draining.

3. The system as defined in claim 1 in which said filter includes a replaceable filter element.

4. The system as defined in claim 1 in which said filter includes a drain and a drain valve for selectively draining said filter.

5. The system as defined in claim 1 in which each of said ashtrays further includes:

a plurality of openings in the ashtray portion thereof;

said openings connected to a second filter;

a vacuum pump having an input connected to said filter and an output.

* * * * *